US010940576B2

(12) United States Patent
Wang

(10) Patent No.: US 10,940,576 B2
(45) Date of Patent: Mar. 9, 2021

(54) HAND TOOL

(71) Applicants: Hangzhou Great Star Tools Co., Ltd., Hangzhou (CN); Hangzhou Great Star Industrial Co., Ltd., Hangzhou (CN)

(72) Inventor: Min Wang, Hangzhou (CN)

(73) Assignees: Hangzhou Great Star Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 399 days.

(21) Appl. No.: 15/566,129

(22) PCT Filed: Apr. 15, 2015

(86) PCT No.: PCT/CN2015/076644
§ 371 (c)(1),
(2) Date: Oct. 12, 2017

(87) PCT Pub. No.: WO2016/165087
PCT Pub. Date: Oct. 20, 2016

(65) Prior Publication Data

US 2018/0085898 A1 Mar. 29, 2018

(51) Int. Cl.
*B25B 7/04* (2006.01)
*B25B 7/10* (2006.01)
(Continued)

(52) U.S. Cl.
CPC ..... *B25B 7/04* (2013.01); *B25B 7/10* (2013.01); *B25B 7/12* (2013.01); *B25B 7/14* (2013.01)

(58) Field of Classification Search
CPC .... B25B 7/02; B25B 7/04; B25B 7/10; B25B 7/12; B25B 7/123; B25B 7/14
(Continued)

(56) References Cited

U.S. PATENT DOCUMENTS 3,854,354 A 12/1974 Angquist
5,996,450 A * 12/1999 St. John ..... B25B 7/00 81/416
(Continued)

FOREIGN PATENT DOCUMENTS

CH 416499 6/1966
CN 2091744 U 1/1992
(Continued)

OTHER PUBLICATIONS

Extended European Search Report for European Patent Application No. 15888792.7 dated Jan. 18, 2019.
(Continued)

*Primary Examiner* — Tyrone V Hall, Jr.
*Assistant Examiner* — Abbie E Quann
(74) *Attorney, Agent, or Firm* — Andrus Intellectual Property Law, LLP

(57) ABSTRACT

A hand tool provided with a first handle, a second handle, a first working portion, a second working portion and a working portion connecting mechanism. The first handle is fixedly connected to the first working portion, the second handle is pivotably connected to the second working portion, and the second working portion is connected to the first working portion through the working portion connecting mechanism, the second working portion has a first position and a second position, and the working portion connecting mechanism causes the second working portion to be moved from the first position to the second position when the second handle is moved from away from the first handle to closer to the first handle. The first position is the position where the second working portion is located away from the first working portion, and the second working portion is rotated and translated relative to the first working portion when the second working portion is in the second position.
(Continued)

The hand tool can provide a greater clamping force, helping to further save labor.

25 Claims, 7 Drawing Sheets

(51) Int. Cl.
*B25B 7/12* (2006.01)
*B25B 7/14* (2006.01)

(58) Field of Classification Search
USPC ..... 81/302, 418
See application file for complete search history.

(56) References Cited

U.S. PATENT DOCUMENTS 7,406,898 B1 8/2008 Hall, Jr.
7,726,217 B2 * 6/2010 Engvall ..... B25B 7/10 81/367
8,056,451 B2 * 11/2011 Chervenak ..... B25B 7/123 81/318
8,266,775 B2 * 9/2012 Bentley ..... B25B 7/123 29/268
2006/0137497 A1 6/2006 Whiteford
2006/0162509 A1 7/2006 Wang
2012/0096994 A1 4/2012 Poole et al.
2014/0230615 A1 8/2014 Gregory

FOREIGN PATENT DOCUMENTS

CN 1103345 A 6/1995
CN 2414881 Y 1/2001
CN 2422093 Y 3/2001
CN 2568363 Y 8/2003
CN 101432100 A 5/2009
CN 103492127 A 1/2014
CN 204546329 U 8/2015
DE 10 2011 000 200 7/2012
EP 2463059 6/2012
GB 2438973 12/2007

OTHER PUBLICATIONS

International Search Report for International Patent Application No. PCT/CN2015/076644 dated Jan. 26, 2016.
Office Action issued for CN Application No. 2017-554292, dated Feb. 19, 2019.

* cited by examiner

HAND TOOL

CROSS-REFERENCE TO RELATED APPLICATIONS

This application is the U.S. national stage application of International Application PCT/CN2015/076644, filed Apr. 15, 2015, which international application was published on Oct. 2, 2016, as International Publication WO 2016/165087 A1, in the Chinese language.

FIELD OF THE INVENTION

The present invention relates to a hand tool and, in particular, to laborsaving pliers.

DESCRIPTION OF THE PRIOR ART

Ordinary pliers generally include a fixed clamping jaw, a movable clamping jaw and handles; the force acting on the handles, through the conversion according to the lever principle, is converted into a larger force on the clamping jaws. However, once the force acting on the handles disappears, the clamping opening is naturally released and cannot continue clamping a work piece. Since the laborsaving pliers use the lever principle twice, the force acting on the handles is converted twice according to the lever principle, and ultimately forms a clamping force several times the applied force at the clamping opening, and thus achieving the purpose of saving labor.

In the existing locking pliers, the movable clamping jaw and the fixed clamping jaw are pivotably connected via a single fixed shaft, and since the distance between the pivot shaft and the clamping opening is relatively far, if it is desirable to further achieve the purpose of saving labor, one method which may be employed is to provide the pivot shaft closer to the clamping opening, but the consequence of this method is that the angle of the clamping opening will be reduced.

SUMMARY OF THE INVENTION

In view of the above-mentioned drawbacks of the prior art, the technical problem to be solved by the present invention is to provide laborsaving pliers which are more laborsaving and ensure a relatively large clamping opening.

To achieve the above object, the present invention provides a hand tool including:

a first handle and a first working portion fixedly connected to the first handle;

a second handle and a second working portion pivotably connected to the second handle; the second working portion has a first position and a second position; and a working portion connecting mechanism through which the second working portion is connected to the first working portion, and the working portion connecting mechanism is configured so that, when the second handle is moved from away from the first handle to closer to the first handle, the working portion connecting mechanism causes the second working portion to be moved from the first position to the second position;

wherein the first position is the position where the second working portion is located away from the first working portion, and compared with the first position, the second working portion is rotated and translated relative to the first working portion when the second working portion is in the second position.

Further, the working portion connecting mechanism includes a hole provided in the first working portion, a groove provided in the second working portion, and a shaft extending through the hole in the first working portion and the groove in the second working portion; the shaft is movable and rotatable within the groove so that the second working portion can be rotated and translated relative to the first working portion.

Alternatively, the working portion connecting mechanism includes a hole provided in the second working portion, a groove provided in the first working portion, and a shaft extending through the hole in the second working portion and the groove in the first working portion; the shaft is movable and rotatable within the groove so that the second working portion can be rotated and translated relative to the first working portion.

Further, the groove is a horizontal groove, a sloped groove or an arc groove.

Preferably, the working portion connecting mechanism includes:

a first hole provided in the first working portion, a first groove provided in the second working portion, and a first shaft extending through the first hole and the first groove;

a second hole provided in the second working portion, a second groove provided in the first working portion, and a second shaft extending through the second hole and the second groove; and the first shaft is movable and rotatable within the first groove and the second shaft is movable and rotatable within the second groove so that the second working portion can be rotated and translated relative to the first working portion.

Alternatively, the working portion connecting mechanism includes:

a first hole provided in the second working portion, a first groove provided in the first working portion, and a first shaft extending through the first hole and the first groove;

a second hole provided in the first working portion, a second groove provided in the second working portion, and a second shaft extending through the second hole and the second groove; and the first shaft is movable and rotatable within the first groove and the second shaft is movable and rotatable within the second groove so that the second working portion can be rotated and translated relative to the first working portion.

Further, the fit clearance between the first shaft and the first hole and the first groove is less than the fit clearance between the second shaft and the second hole and the second groove.

Alternatively, the fit clearance between the first shaft and the first hole and the first groove is equal to the fit clearance between the second shaft and the second hole and the second groove.

Alternatively, the fit clearance between the first shaft and the first hole and the first groove is greater than the fit clearance between the second shaft and the second hole and the second groove.

Further, the first groove is an arc groove or a square groove.

Further, the second groove is an arc groove or a square groove.

In a preferred embodiment of the present invention, there is provided a hand tool including:

a first handle and a first working portion fixedly connected to the first handle;

a second handle and a second working portion pivotably connected to the second handle; the second working portion has a first position and a second position;

a working portion connecting mechanism through which the second working portion is connected to the first working portion, and the working portion connecting mechanism is configured so that, when the second handle is moved from away from the first handle to closer to the first handle, the working portion connecting mechanism causes the second working portion to be moved from the first position to the second position; and a rod-shaped member which is provided between the second handle and the first handle;

wherein the first position is the position where the second working portion is located away from the first working portion, and compared with the first position, the second working portion is rotated and translated relative to the first working portion when the second working portion is in the second position.

Further, the working portion connecting mechanism includes a hole provided in the first working portion, a groove provided in the second working portion, and a shaft extending through the hole in the first working portion and the groove in the second working portion; the shaft is movable and rotatable within the groove so that the second working portion can be rotated and translated relative to the first working portion.

Alternatively, the working portion connecting mechanism includes a hole provided in the second working portion, a groove provided in the first working portion, and a shaft extending through the hole in the second working portion and the groove in the first working portion; the shaft is movable and rotatable within the groove so that the second working portion can be rotated and translated relative to the first working portion.

Further, the groove is a horizontal groove, a sloped groove or an arc groove.

Preferably, the working portion connecting mechanism includes:

a first hole provided in the first working portion, a first groove provided in the second working portion, and a first shaft extending through the first hole and the first groove;

a second hole provided in the second working portion, a second groove provided in the first working portion, and a second shaft extending through the second hole and the second groove; and the first shaft is movable and rotatable within the first groove and the second shaft is movable and rotatable within the second groove so that the second working portion can be rotated and translated relative to the first working portion.

Alternatively, the working portion connecting mechanism includes:

a first hole provided in the second working portion, a first groove provided in the first working portion, and a first shaft extending through the first hole and the first groove;

a second hole provided in the first working portion, a second groove provided in the second working portion, and a second shaft extending through the second hole and the second groove;

the first shaft is movable and rotatable within the first groove and the second shaft is movable and rotatable within the second groove so that the second working portion can be rotated and translated relative to the first working portion.

Further, the fit clearance between the first shaft and the first hole and the first groove is less than the fit clearance between the second shaft and the second hole and the second groove.

Alternatively, the fit clearance between the first shaft and the first hole and the first groove is equal to the fit clearance between the second shaft and the second hole and the second groove.

Alternatively, the fit clearance between the first shaft and the first hole and the first groove is greater than the fit clearance between the second shaft and the second hole and the second groove.

Further, the first groove is an arc groove or a square groove.

Further, the second groove is an arc groove or a square groove.

Further, the hand tool further includes an elastic member provided between the second working portion and the first handle.

Further, a hanging hole is provided in the second working portion, a hook portion is provided in the first handle, one end of the elastic member is restricted within the hanging hole and the other end is connected to the hook portion.

Further, the hand tool further includes an adjustment screw, and the adjustment screw is connected to the tail portion of the first handle through thread.

Further, the rod-shaped member has a first end and a second end, the first end of the rod-shaped member is pivotably connected to the second handle, and the second end of the rod-shaped member is pivotably connected to the first handle and abuts against the adjustment screw.

Further, the adjustment screw causes the second end of the rod-shaped member to be moved relative to the first handle when the adjustment screw is moved relative to the first handle.

Further, a recess is provided within the first handle, the opening of the recess faces the second handle.

Further, a portion of the adjustment screw extends within the recess of the first handle and the other portion is positioned outside the first handle.

Further, a recess is provided within the second handle, the opening of the recess faces the first handle.

Further, a third handle is pivotably connected within the recess of the second handle.

Further, the length of the third handle is less than that of the second handle.

Further, the third handle has an elongated end which, when the third handle is pivoted relative to the second handle, can abut against the second handle to prevent the third handle from continuing being pivoted relative to the second handle.

Further, the rod-shaped member has a protrusion, the hand tool is locked when the protrusion enters the recess of the second handle; the elongated end can push the protrusion out from the recess of the second handle to unlock the hand tool when the third handle is rotated towards the second handle.

Further, the joint between the third handle and the second handle is separated from the joint between the rod-shaped member and the second handle, and is farther away from the second working portion than the joint between the rod-shaped member and the second handle.

Further, the joint between the rod-shaped member and the second handle is separated from the joint between the second working portion and the second handle.

In another preferred embodiment of the present invention, there is provided a hand tool including:

a first handle and a first working portion fixedly connected to the first handle;

a second handle and a second working portion pivotably connected to the second handle; the second working portion has a first position and a second position;

a working portion connecting mechanism through which the second working portion is connected so that when the second handle is moved from away from the first handle to closer to the first handle, the working portion connecting mechanism causes the second working portion to be moved from the first position to the second position;

a rod-shaped member which is provided between the second handle and the first handle; and a stopper mechanism which is used for stopping the displacement of the rod-shaped member relative to the second handle;

wherein the first position is the position where the second working portion is located away from the first working portion, and compared with the first position, the second working portion is rotated and translated relative to the first working portion when the second working portion is in the second position.

Further, the working portion connecting mechanism includes a hole provided in the first working portion, a groove provided in the second working portion, and a shaft extending through the hole in the first working portion and the groove in the second working portion; the shaft is movable and rotatable within the groove so that the second working portion can be rotated and translated relative to the first working portion.

Alternatively, the working portion connecting mechanism includes a hole provided in the second working portion, a groove provided in the first working portion, and a shaft extending through the hole in the second working portion and the groove in the first working portion; the shaft is movable and rotatable within the groove so that the second working portion can be rotated and translated relative to the first working portion.

Further, the groove is a horizontal groove, a sloped groove or an arc groove.

Preferably, the working portion connecting mechanism includes:

a first hole provided in the first working portion, a first groove provided in the second working portion, and a first shaft extending through the first hole and the first groove;

a second hole provided in the second working portion, a second groove provided in the first working portion, and a second shaft extending through the second hole and the second groove; and the first shaft is movable and rotatable within the first groove and the second shaft is movable and rotatable within the second groove so that the second working portion can be rotated and translated relative to the first working portion.

Alternatively, the working portion connecting mechanism includes:

a first hole provided in the second working portion, a first groove provided in the first working portion, and a first shaft extending through the first hole and the first groove;

a second hole provided in the first working portion, a second groove provided in the second working portion, and a second shaft extending through the second hole and the second groove; and the first shaft is movable and rotatable within the first groove and the second shaft is movable and rotatable within the second groove such that the second working portion can be rotated and translated relative to the first working portion.

Further, the fit clearance between the first shaft and the first hole and the first groove is less than the fit clearance between the second shaft and the second hole and the second groove.

Alternatively, the fit clearance between the first shaft and the first hole and the first groove is equal to the fit clearance between the second shaft and the second hole and the second groove.

Alternatively, the fit clearance between the first shaft and the first hole and the first groove is greater than the fit clearance between the second shaft and the second hole and the second groove.

Further, the first groove is an arc groove or a square groove.

Further, the second groove is an arc groove or a square groove.

Further, the stopper mechanism includes a kidney-shaped hole provided in the second working portion and a stopper shaft provided within the kidney-shaped hole, and the rod-shaped member is pivotably connected to the second handle through the stopper shaft, the stopper shaft cooperates with the kidney-shaped hole to form the stopper mechanism.

Further, the first working portion and the second working portion are in a released state when the stopper shaft is facing the first handle in the kidney-shaped hole; the first working portion and the second working portion are in a clamped state when the stopper shaft is away from the first handle in the kidney-shaped hole.

Further, a recess is provided within the second handle, the opening of the recess faces the first handle.

Further, a third handle is provided within the recess of the second handle, the third handle is connected to the second handle, and the third handle is connected to the rod-shaped member via the stopper shaft.

Further, the joint between the third handle and the second handle is separated from the joint between the second handle and the second working portion, and the joint between the third handle and the second handle is separated from the joint between the third handle and the rod-shaped member.

Further, the length of the second handle is greater than that of the third handle.

Further, during rotation of the second handle, the joint between the rod-shaped member and the third handle would pass over the connection line connecting the joint between the third handle and the second handle and the joint between the second handle and the second working portion; and the first working portion and the second working portion are clamped when the second handle is moved closer to the first handle and passes over the connection line; and the first working portion the second working portion are released when the second handle is moved away from the first handle and passes over the connection line.

Further, the hand tool further includes an elastic member provided between the second working portion and the first handle.

Further, a hanging hole is provided in the second working portion, a hook portion is provided in the first handle, one end of the elastic member is restricted within the hanging hole and the other end is connected to the hook portion.

Further, the hand tool further includes an adjustment screw, and the adjustment screw is connected to the tail portion of the first handle through thread.

Further, the rod-shaped member has a first end and a second end, the first end of the rod-shaped member is pivotably connected to the second handle, and the second end of the rod-shaped member is pivotably connected to the first handle and abuts against the adjustment screw.

Further, the adjustment screw causes the second end of the rod-shaped member to be moved relative to the first handle when the adjustment screw is moved relative to the first handle.

Further, a recess is provided within the first handle, the opening of the recess faces the second handle.

Further, a portion of the adjustment screw extends within the recess of the first handle and the other portion is positioned outside the first handle.

In yet another preferred embodiment of the present invention, there is provided a hand tool including:

a first handle and a first working portion fixedly connected to the first handle;

a second handle and a second working portion pivotably connected to the second handle; the second working portion has a first position and a second position;

a working portion connecting mechanism through which the second working portion is connected to the first working portion, and the working portion connecting mechanism is configured so that, when the second handle is moved from away from the first handle to closer to the first handle, the working portion connecting mechanism causes the second working portion to be moved from the first position to the second position;

a sliding mechanism which is slidably mounted on the first handle;

a rod-shaped member, one end of which is pivotably connected to the second handle and the other end is pivotably mounted onto the sliding mechanism; and wherein the first position is the position where the second working portion is located away from the first working portion, and compared with the first position, the second working portion is rotated and translated relative to the first working portion when the second working portion is in the second position.

Further, the working portion connecting mechanism includes a hole provided in the first working portion, a groove provided in the second working portion, and a shaft extending through the hole in the first working portion and the groove in the second working portion; the shaft is movable and rotatable within the groove so that the second working portion can be rotated and translated relative to the first working portion.

Alternatively, the working portion connecting mechanism includes a hole provided in the second working portion, a groove provided in the first working portion, and a shaft extending through the hole in the second working portion and the groove in the first working portion; the shaft is movable and rotatable within the groove so that the second working portion can be rotated and translated relative to the first working portion.

Further, the groove is a horizontal groove, a sloped groove or an arc groove.

Preferably, the working portion connecting mechanism includes:

a first hole provided in the first working portion, a first groove provided in the second working portion, and a first shaft extending through the first hole and the first groove;

a second hole provided in the second working portion, a second groove provided in the first working portion, and a second shaft extending through the second hole and the second groove; and the first shaft is movable and rotatable within the first groove and the second shaft is movable and rotatable within the second groove so that the second working portion can be rotated and translated relative to the first working portion.

Alternatively, the working portion connecting mechanism includes:

a first hole provided in the second working portion, a first groove provided in the first working portion, and a first shaft extending through the first hole and the first groove;

a second hole provided in the first working portion, a second groove provided in the second working portion, and a second shaft extending through the second hole and the second groove; and the first shaft is movable and rotatable within the first groove and the second shaft is movable and rotatable within the second groove such that the second working portion can be rotated and translated relative to the first working portion.

Further, the fit clearance between the first shaft and the first hole and the first groove is less than the fit clearance between the second shaft and the second hole and the second groove.

Alternatively, the fit clearance between the first shaft and the first hole and the first groove is equal to the fit clearance between the second shaft and the second hole and the second groove.

Alternatively, the fit clearance between the first shaft and the first hole and the first groove is greater than the fit clearance between the second shaft and the second hole and the second groove.

Further, the first groove is an arc groove or a square groove.

Further, the second groove is an arc groove or a square groove.

Further, one end of the rod-shaped member connected to the sliding mechanism is constituted by curve segments, and the curvature of the curve segment closer to the first handle is greater than that of the curve segment away from the first handle.

Further, the hand tool further includes a locking mechanism which is slidably mounted onto the first handle and located on the distal end of the sliding mechanism close to the first handle.

Further, the locking mechanism includes a guide rod and a locking tab, and the guide rod is mounted on the first handle and equipped through the locking tab.

Further, the locking tab is formed of a plurality of pieces, and the plurality of pieces of the locking tab are attached to each other.

Further, the cross-section of the guide rod is a trapezium with rounded corners, and the locking tab has an aperture in the middle through which the guide rod passes, the aperture is provided with a cross-section of a trapezium with rounded corners of the same shape as the cross-section of the guide rod, and there is a clearance fit between the guide rod and the locking tab.

Further, the adjustment mechanism is mounted on the guide rod and is located between the sliding mechanism and the locking mechanism, and the adjustment mechanism is configured to be displaceable in the length direction of the guide rod.

Further, the adjustment mechanism is configured so that, when the adjustment mechanism reaches the maximum displacement towards either end of the guide rod, one end of the rod-shaped member connected to the sliding mechanism can be brought into contact with the adjustment mechanism when the hand tool is locked.

Further, the adjustment mechanism includes an adjustment bolt and a carrier, and the carrier is mounted on the guide rod, the adjustment screw is mounted on the carrier and is displaceable in the direction of the guide rod relative to the carrier.

Further, the carrier has a cross section which is the same as the cross section of the locking tab and has an aperture having the same size as that of the locking tab at the same location as the locking tab, and the guide rod passes through the aperture in the carrier.

Further, a recess is provided within the second handle, the opening of the recess faces the first handle, and a third handle is pivotably connected within the recess of the second handle.

Further, the third handle has an elongated end which, when the third handle is pivoted relative to the second handle, can abut against the second handle to prevent the third handle from continuing being pivoted relative to the second handle.

Further, the rod-shaped member has a protrusion, the hand tool is locked when the protrusion enters the recess of the second handle; the elongated end can push the protrusion out from the recess of the second handle to unlock the hand tool when the third handle is turned towards the second handle.

The hand tools provided by the present invention may be laborsaving pliers, water pump pliers or the like, wherein a first working portion and a second working portion are connected through a working portion connecting mechanism, regardless of whether the working portion connecting mechanism uses a one-shaft or two-shaft arrangement, the shaft center of rotation of the second working portion relative to the first working portion is closer to the clamping opening than the existing locking pliers, and thus it is more laborsaving than the existing locking pliers. In addition, since the shaft is provided in the groove, that is, when the second working portion is moved relative to the first working portion, the shaft is moved and rotated within the groove, or the groove is moved relative to the shaft, thereby ensuring a large clamping opening. On the other hand, when an article is clamped, since the shaft is movable relative to the groove, the second working portion is also translated in addition to rotation relative to the first working portion, so that the contact area (i.e., the gripping area) between the second working portion and the first working portion and the clamped article is increased, thus making the gripping more effective.

The concepts, the specific structures and the technical effects of the present invention will be further illustrated below in conjunction with the accompanying drawings, in order to fully understand the objects, features and effects of the present invention.

DETAILED DESCRIPTION OF THE PREFERRED EMBODIMENTS

Figure 1:
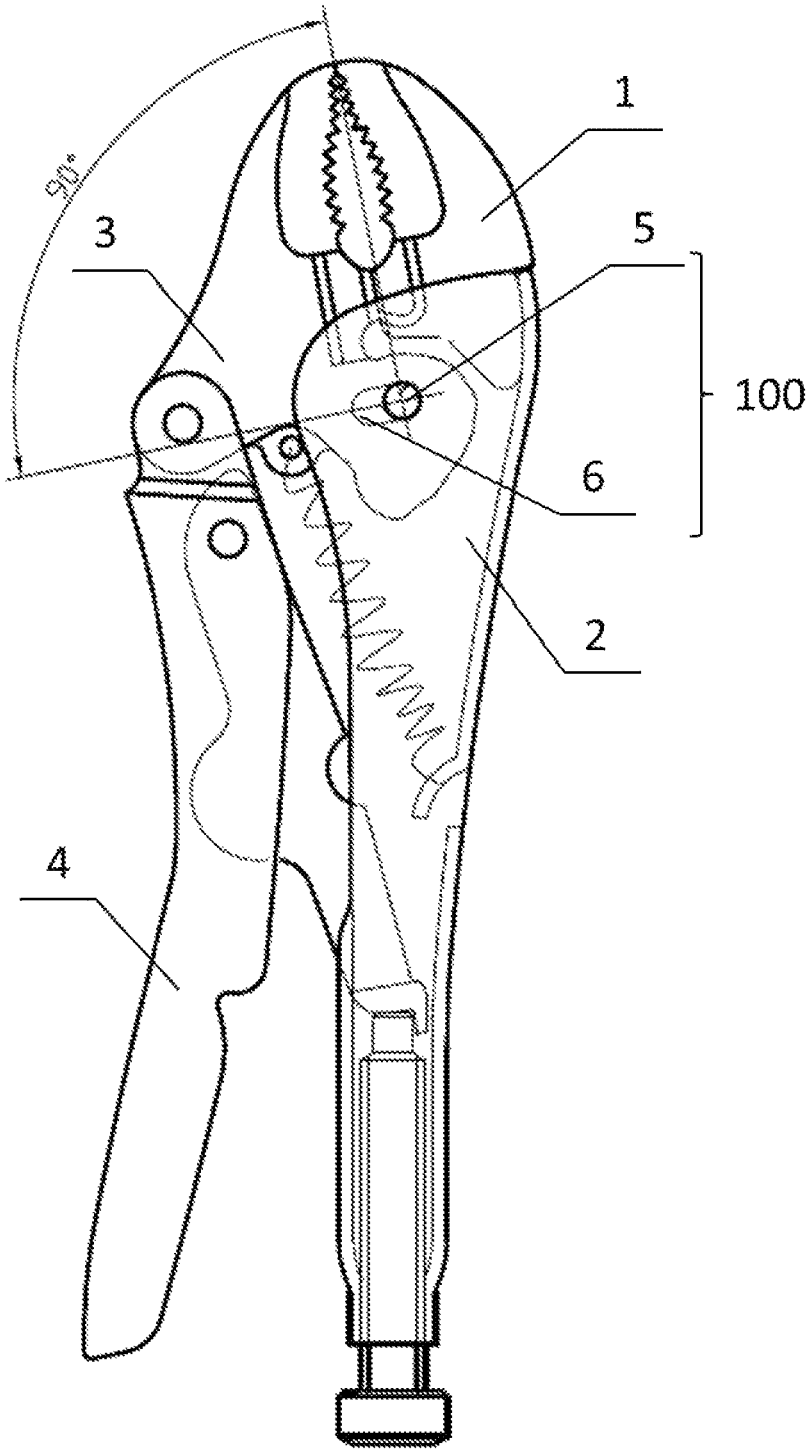
FIG. 1 is a schematic view of a hand tool according to a preferred embodiment of the present invention, showing the shape of the horizontal groove when the first working portion and the second working portion are connected via one shaft.

As shown in FIGS. 1 to 4, a preferred embodiment of the present invention provides a hand tool including a first handle 2, a first working portion 1, a second handle 4, a second working portion 3, and a working portion connecting mechanism. Wherein, the first handle 2 is fixedly connected to the second handle 4, and in an alternative embodiment, the first handle 2 and the second handle 4 may be integral. The second handle 4 is pivotably connected to the second working portion 3, and the second working portion 3 has a first position and a second position. Here, the first position of the second working portion 3 refers to the position where the second working portion 3 is located away from the first working portion 1; compared with the first position, the second working portion 3 is rotated and translated relative to the first working portion 1 when the second working portion 3 is in the second position. In an embodiment of the present invention, the first working portion 1 and the second working portion 3 cooperate to form a clamping opening for clamping an article or a shearing opening for shearing an article, and the formation of the clamping opening or the shearing opening depends on the shape of cooperative site between the first working portion 1 and the second working portion 3.

The second working portion 3 is connected to the first working portion 1 through the working portion connecting mechanism 100, and the working portion connecting mechanism 100 is configured so that, when the second handle 4 is moved from away from the first handle 2 to closer to the first handle 2, the working portion connecting mechanism 100 causes the second working portion 3 to be moved from the first position to the second position.

Figure 2:
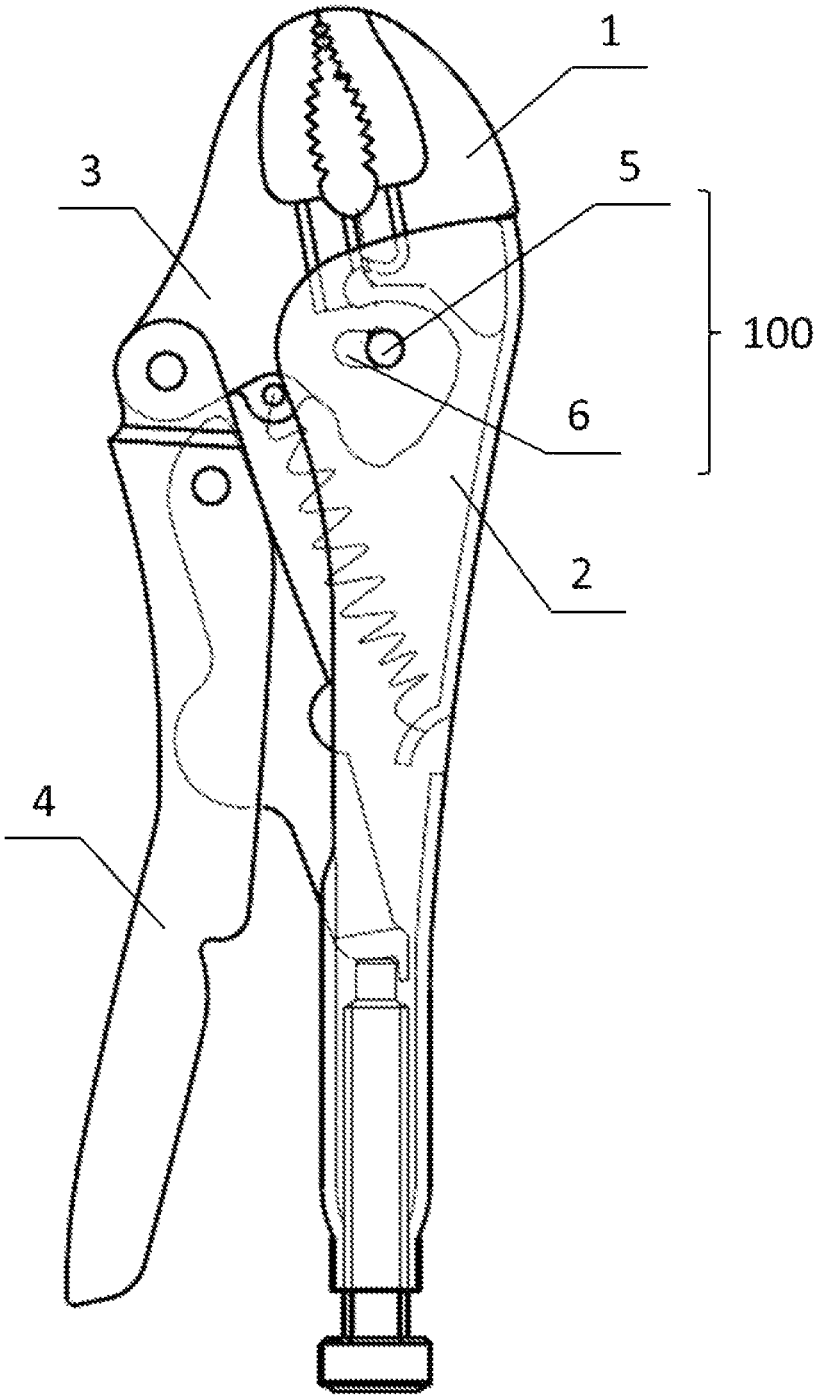
FIG. 2 is a schematic view of a hand tool according to a preferred embodiment of the present invention, showing the shape of the sloped groove when the first working portion and the second working portion are connected via one shaft.
Figure 3:
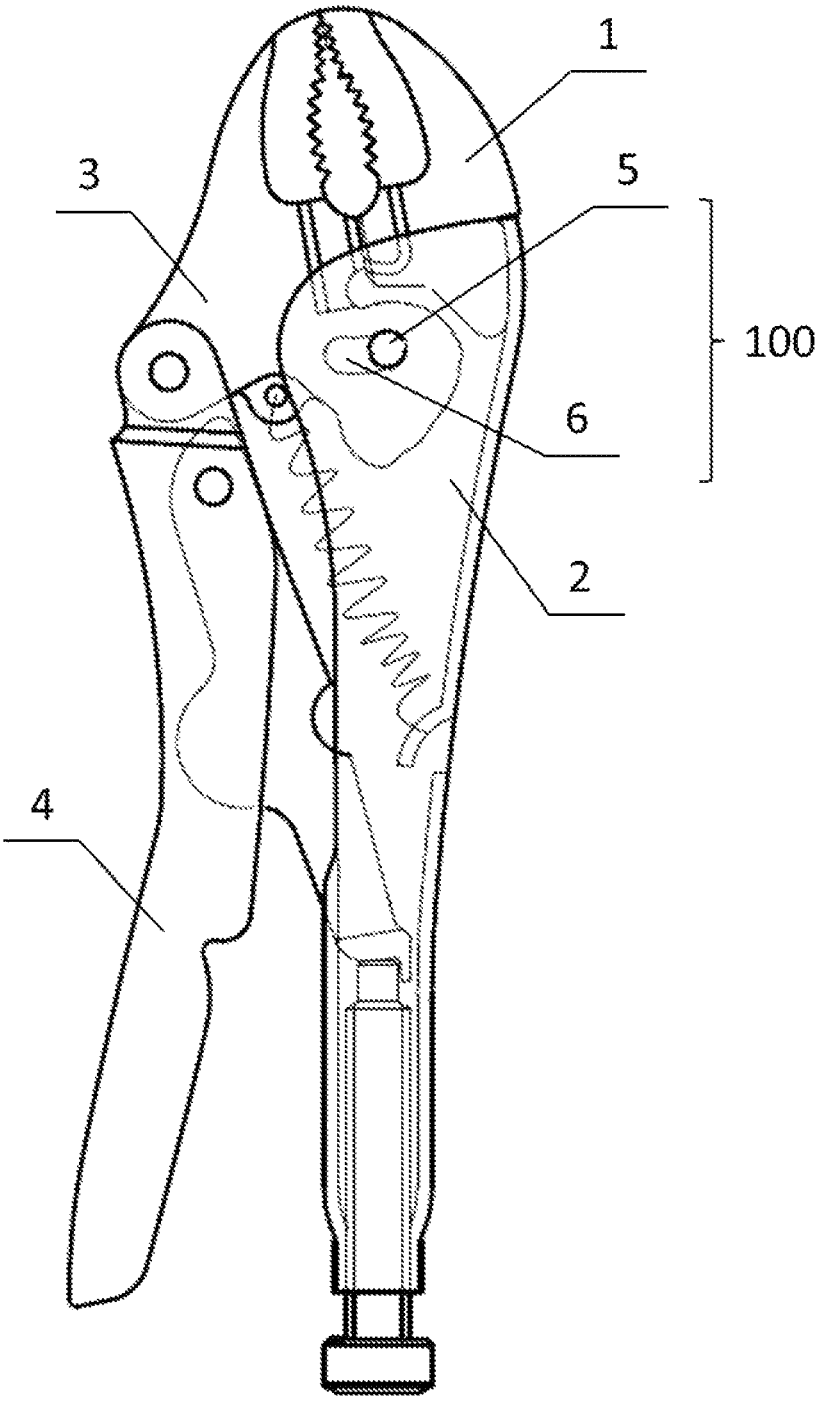
FIG. 3 is a schematic view of a hand tool according to a preferred embodiment of the present invention, showing the shape of the arc groove when the first working portion and the second working portion are connected via one shaft.

Specifically, as shown in FIGS. 1 to 3, the working portion connecting mechanism 100 includes a hole provided in the first working portion 1, a groove 6 provided in the second working portion 3, and a shaft 5 extending through the hole in the first working portion 1 and the groove 6 in the second working portion 3; the shaft 5 is movable and rotatable within the groove 6 so that the second working portion 3 can be rotated and translated relative to the first working portion 1. But it is not limited to this, in an alternative embodiment, the hole is provided in the second working portion 3, the groove 6 is provided in the first working portion 1, the shaft 5 extends through the hole in the second working portion 3 and the groove 6 in the first working portion 1; the shaft 5 is movable and rotatable within the groove 6 so that the second working portion 3 can be rotated and translated relative to the first working portion 1.

The groove 6 provided in the first working portion 1 or the second working portion 3 may be designed as a horizontal groove, a sloped groove or an arc groove in order to prevent the misalignment when the first working portion 1 and the second working portion 3 cooperate. In this way, when the first handle 2 and the second handle 4 are subjected to an external force to cause the second handle 4 to be rotated relative to the first handle 2, the second working portion 3 is rotated about the shaft 5, and since the groove 6 is moved relative to the shaft 5, that is, the shaft 5 is moved within the groove 6 along the shape of the groove 6 relative to the groove 6, causing the second working portion 3 also to be translated relative to the first working portion 1. The advantage of translation of the second working portion 3 relative to the first working portion 1 is that, when the hand tool is used for clamping an article, the angle of the first working portion 1, the second working portion 3 and the clamped article can be automatically adjusted in accordance with the shape and thickness of the clamped article, to obtain an optimal contact. If the first working portion 1 and the second working portion 3 are thin, the clamped article can only be clamped in a scissors-like manner. In addition, it is possible to increase the contact area between the first working portion 1 and the second working portion 3 and the clamped article, that is, the gripping area is increased, so that the gripping of the article is more reliable and effective. Here, the horizontal groove is defined as the groove which is on the vertical line of the connection line connecting the closing point of the first working portion 1 and the second working portion 3 and the clamping shaft center of the shaft 5 when the clamping opening or the shearing opening formed by the first working portion 1 and the second working portion 3 is closed, that is, the grooving direction of the groove 6 is on the vertical line of the connection line connecting the closing point of the first working portion 1 and the second working portion 3 and the clamping shaft center of the shaft 5. If the groove 6 or the grooving direction thereof is not on the vertical line of the connection line connecting the closing point of the first working portion 1 and the second working portion 3 and the clamping shaft center of the shaft 5 (i.e., the groove 6 is not vertical to the connection line), it is a sloped groove. The arc groove is a special case in the sloped grooves, and the arc groove makes the motion trail of the shaft 5 within the groove 6 relative to the groove 6 an arc.

Figure 4:
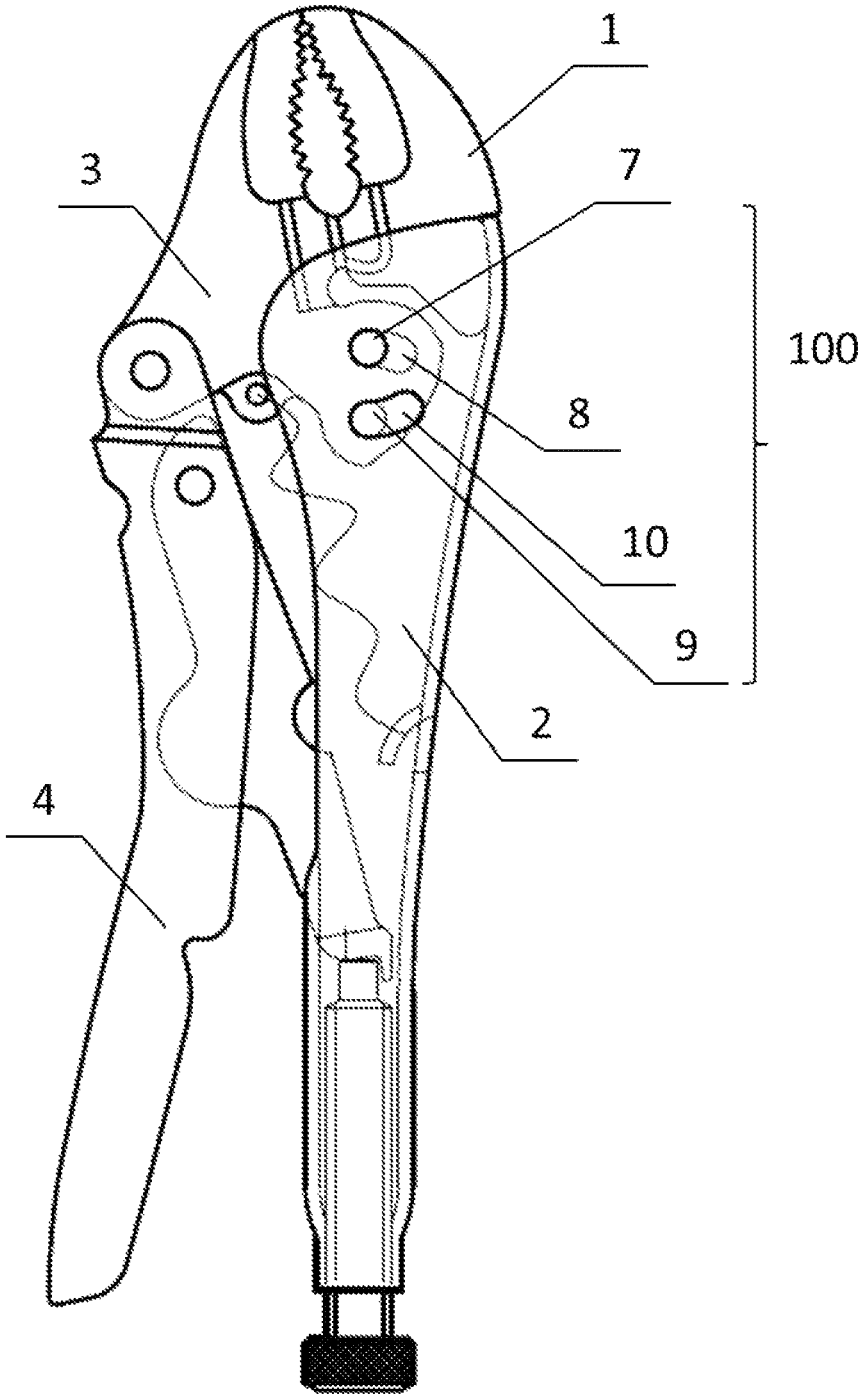
FIG. 4 is a schematic view of a hand tool according to a preferred embodiment of the present invention, showing the shape of the arc groove when the first working portion and the second working portion are connected via two shafts.

As another preferred embodiment, as shown in FIG. 4, the working portion connecting mechanism 100 includes a first hole provided in the first working portion 1, a first groove 8 provided in the second working portion 3, and a first shaft 7 extending through the first hole and the first groove 8; a second hole provided in the second working portion 3, a second groove 10 provided in the first working portion 1, and a second shaft 9 extending through the second hole and a second groove 10. But it is not limited to this, in an alternative embodiment, the first hole is provided in the second working portion 3, and the first groove 8 is provided in the first working portion 1, and the first shaft 9 extends through the first hole in the second working portion 3 and the first groove 8 in the first working portion 1; the second hole is provided in the first working portion 1, the second groove 10 is provided in the second working portion 3, and the second shaft 9 extends through the second hole in the first working portion 1 and the second groove 10 in the second working portion 3. The first shaft 7 is movable and rotatable within the first groove 8 (or the first groove 8 is movable and rotatable relative to the first shaft 7), and the second shaft 9 is movable and rotatable within the second groove 10 so that the second working portion 3 can be rotated and translated relative to the first working portion 1. The first shaft 7 is closer to the clamping or shearing region formed by the first working portion 1 and the second working portion 3 than the second shaft 9. Wherein, the first groove 7 may be an arc groove or a square groove, and the second groove 9 may be an arc groove or a square groove.

In a preferred embodiment of the present invention, the fit clearance between the first shaft 7 and the first hole and the first groove 8 is generally set to be smaller than the fit clearance between the second shaft 9 and the second hole and the second groove 10. In this way, when the first handle 2 and the second handle 4 are subjected to an external force to cause the first working portion 1 and the second working portion 3 to clamp or shear an article, since the fit clearance between the first shaft 7 and the first hole and the first groove 8 is smaller, compared with the second shaft 9, the first shaft 7 is first subjected to a force applied thereto by the first groove 8 until the first shaft 7 cannot continue moving relative to the first groove 8 under this force, or the second shaft 9 begins to be subjected to a force applied thereto by the second groove 10 when the first groove 8 cannot continue moving relative to the first shaft 7. Thus, in this case, the first shaft 7 plays a major role in bearing the force, and the second shaft 9 plays a role in assisting the first shaft 7 to bear the external force.

In other embodiments of the present invention, the fit clearance between the first shaft 7 and the first hole and the first groove 8 is set to be equal to the fit clearance between the second shaft 9 and the second hole and the second groove 10. In this case, when the first handle 2 and the second handle 4 are subjected to an external force to cause the first working portion 1 and the second working portion 3 to clamp or shear an article, since the fit clearance between the first shaft 7 and the first hole and the first groove 8 is equal to the fit clearance between the second shaft 9 and the second hole and the second groove 10, the first shaft 7 is subjected to a force applied thereto by the first groove 8 while the second shaft 9 is subjected to a force applied thereto by the second groove 10, i.e., the first shaft 7 and the second shaft 9 bear the external force equally.

In other embodiments of the present invention, if the fit clearance between the first shaft 7 and the first hole and the first groove 8 is set to be greater than the fit clearance between the second shaft 9 and the second hole and the second groove 10, the second shaft 9 plays a major role in bearing the force, and the first shaft 7 assists the second shaft 9 to bear the external force.

The function of providing two shafts (the first shaft 7 and the second shaft 9) in this embodiment is to make the two shafts bear the external force together (whether one of the shafts plays a major role in bearing the force and the other shaft plays a role in assisting to bear the force, or the two shafts bear the force equally), the wear of the shaft and the deformation of the hand tool can be reduced when compared with the situation where only one shaft is provided. On the other hand, the function of providing two shafts is also that the size of the clamping opening or shearing opening formed by the rotation of the second working portion 3 about the first shaft 7 relative to the first working portion 1 can be limited by the second shaft 9, to prevent the clamping opening or shearing opening from being too large to affect the actual use, and enable the clamping opening or shearing opening to have an appropriate size. It also limits the opening distance between the first handle 2 and the second handle 4 from being too large, so that it is convenient for a user to operate with one hand.

Figure 5:
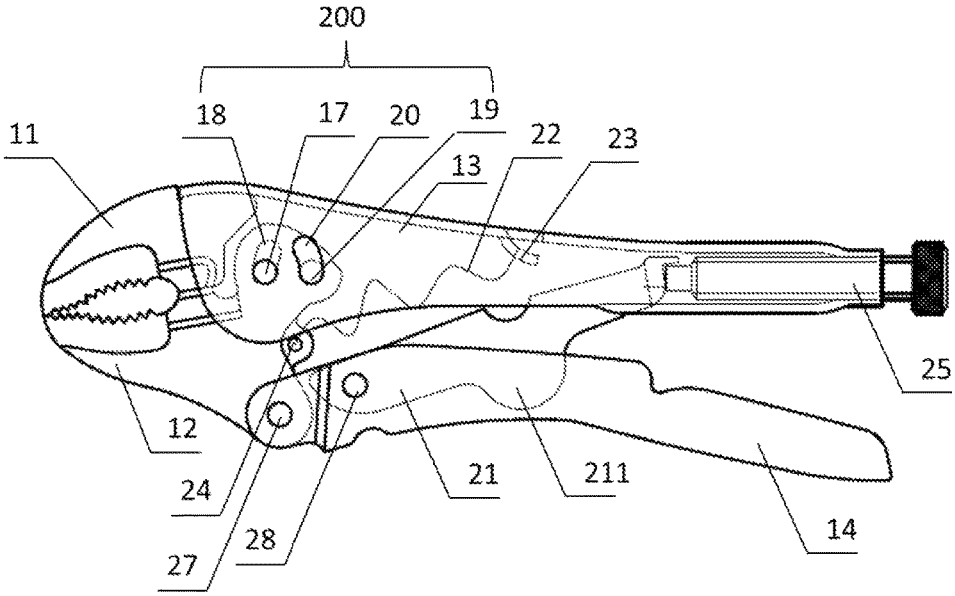
FIG. 5 is a schematic view of laborsaving pliers in a specific embodiment of the present invention in which the clamping opening is in a closed state.
Figure 6:
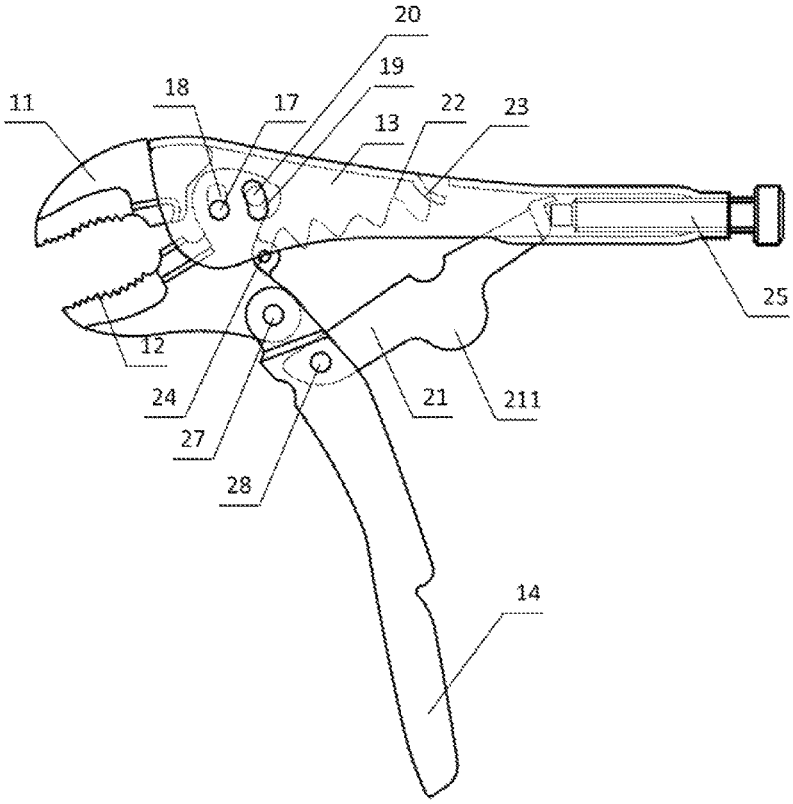
FIG. 6 is a schematic view of laborsaving pliers in a specific embodiment of the present invention in which the clamping opening is in an open state.
Figure 7:
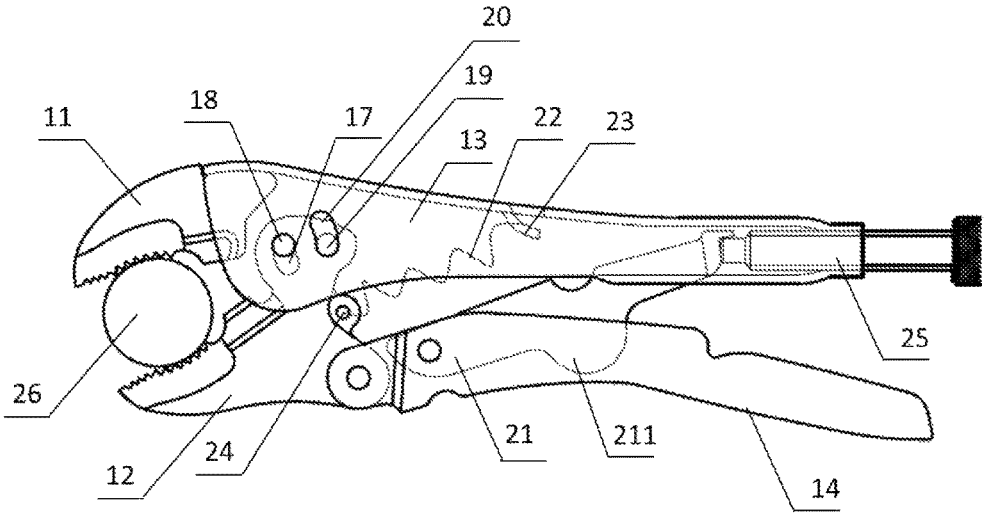
FIG. 7 is a schematic view of laborsaving pliers in a specific embodiment of the present invention in which the clamping opening is in the state of gripping an article.

FIGS. 5 to 7 show a specific embodiment of the present invention, which provides a hand tool, specifically labor-saving pliers, including a first handle 13, a second handle 14, a first working portion 11, a second working portion 12, a working portion connecting mechanism 200, a rod-shaped member 21, an elastic member 22, a third handle (not shown), and an adjustment screw 25. Wherein, the first handle 13 is fixedly connected to the first working portion 11, and they may be integrally formed. The second handle 14 is pivotably connected to the second working portion 12. In this embodiment, the working portion connecting mechanism uses the two-shaft arrangement as described earlier, that is, includes a first hole provided in the first working portion 11, a first groove 18 provided in the second working portion 12, and a first shaft 17 extending through the first hole and the first groove 18; a second hole provided in the second working portion 12, a second groove 20 provided in the first working portion, and a second shaft 19 extending through the second hole and the second groove 20. The first shaft 17 is closer to the clamping opening formed by the first working portion 11 and the second working portion 12 than the second shaft 19. The first shaft 17 is movable and rotatable within the first groove 18 and the second shaft 19 is movable and rotatable within the second groove 20 so that the second working portion 12 can be rotated and translated relative to the first working portion 11. Wherein, the first groove 18 and the second groove 20 are arc grooves or may be square grooves. As an alternative embodiment, the working portion connecting mechanism 200 may also use the one-shaft arrangement as described earlier (not shown here), that is, the working portion connecting mechanism 200 includes a hole provided in the first working portion 11, a groove provided in the second working portion 12, and a shaft extending through the hole in the first working portion and the groove in the second working portion 12. In the case of one-shaft arrangement, the groove may be a horizontal groove, a sloped groove or an arc groove.

In this embodiment, the second working portion 12 has a first position and a second position. The second working portion 12 is connected to the first working portion 11 through the working portion connecting mechanism 200. The working portion connecting mechanism 200 causes the second working portion 12 to move from the first position to the second position when the second handle 14 is moved from away from the first handle 13 to closer to the first handle 13. Here, the first position of the second working portion 12 refers to the position where the second working portion 12 is located away from the first working portion 11, and compared with the first position, the second working portion 12 is rotated and translated relative to the first working portion 11 when the second working portion 12 is in the second position.

In this embodiment, the fit clearance between the first shaft 17 and the first hole and the first groove 18 is less than the fit clearance between the second shaft 19 and the second hole and the second groove 20. In an alternative embodiment of this embodiment, the fit clearance between the first shaft 17 and the first hole and the first groove 18 may also be set to be equal to or greater than the fit clearance between the second shaft 19 and the second hole and the second groove 20. As mentioned earlier, one function of providing two shafts is to bear the external force together by the two shafts, thereby reducing the wear of the shaft and the deformation of the laborsaving pliers, and the other function is to limit the size of the clamping opening by means of the second shaft 19 and to limit the opening distance between the first handle 13 and the second handle 14 from being too large, so that it is convenient for a user to operate with one hand.

In the laborsaving pliers of this embodiment, a recess extending in the length direction of the first handle 13 is provided within the first handle 13, the opening of the recess faces the second handle 14, and a recess extending in the length direction of the second handle 14 is provided within the second handle 14, and the opening of the recess faces the first handle 13. A first end of the rod-shaped member 21 is provided within the recess of the second handle 14, and the first end of the rod-shaped member 21 is pivotably connected to the second handle 14. A second end of the rod-shaped member 21 and an adjustment screw 25 are provided within the recess of the first handle 13, and the second end of the rod-shaped member 21 contacts a first end of the adjustment screw 25, the adjustment screw 25 extends within the recess of the first handle 13 in the length direction of the first handle 13 so that a second end of the adjustment screw 25 passes through an annular hole provided in the tail portion of the first handle 13 (i.e., the end away from the clamping opening) until the second end of the adjustment screw 25 is located outside the first handle 13. The annular hole is provided with internal thread that cooperates with the thread of the adjustment screw 25, and the diameter of the annular hole is smaller than the diameter of the second end of the adjustment screw 25, so that the second end of the adjustment screw 25 cannot enter the first handle 13 through the annular hole.

The rotation of the adjustment screw 25 can change the position of the first end of the adjustment screw 25 within the recess of the first handle 13 so as to adjust the size of the clamping opening formed by the first working portion 11 and the second working portion 12 to accommodate clamped articles 26 of different sizes. Specifically, when the rotation of the adjustment screw 25 moves the second end of the adjustment screw 25 away from the clamping opening, the second end of the rod-shaped member 21 moves away from the clamping opening as the first end of the adjustment screw 25 moves, the first end of the rod-shaped member 21 pulls the second handle 14 through the joint 28 between the rod-shaped member 21 and the second handle 14, and then the second handle 14 pulls the second working portion 12 through the joint 27 between the second handle 14 and the second working portion 12, since the second working portion 12 is simultaneously limited by the first shaft 17 and the second shaft 19, the second working portion 12 pivots about the first shaft 17 and the second shaft 19 away from the first working portion 11, so that the clamping opening becomes wider. When the rotation of the adjustment screw 25 moves the second end of the adjustment screw 25 closer to the clamping opening, the second end of the rod-shaped member 21 moves closer to the clamping opening as the first end of the adjustment screw 25 moves, the first end of the rod-shaped member 21 pushes the second handle 14 through the joint 28 between the rod-shaped member 21 and the second handle 14, and then the second handle 14 pushes the second working portion 12 through the joint 27 between the second handle 14 and the second working portion 12, since the second working portion 12 is simultaneously limited by the first shaft 17 and the second shaft 19, the second working portion 12 pivots about the first shaft 17 and the second shaft 19 closer to the first working portion 11, so that the clamping opening becomes narrower.

In the laborsaving pliers of this embodiment, the elastic member 22 is provided between the second working portion 12 and the first handle 13, and specifically, a hanging hole 24 is provided in the second working portion 12, a hook portion 23 is provided within the recess of the first handle 13, one end of the elastic member 22 is restricted within the hanging hole 24 and the other end is connected to the hook portion 23. The elastic member 22 of this embodiment is a spring, specifically a tension spring.

In the laborsaving pliers of this embodiment, a third handle is pivotably connected within the recess of the second handle 14. The length of the third handle is less than that of the second handle 14. The third handle has an elongated end which, when the third handle is pivoted relative to the second handle 14, can abut against the second handle 14 to prevent the third handle from continuing being pivoted relative to the second handle 14. In addition, the rod-shaped member 21 has a protrusion 211, the hand tool is locked when the protrusion 211 enters the recess of the second handle 14; the elongated end of the third handle can push the protrusion 211 of the rod-shaped member 21 out from the recess of the second handle 14 to unlock the laborsaving pliers when the third handle is turned towards the second handle 14.

In the laborsaving pliers of this embodiment, the joint between the third handle and the second handle 14 is separated from the joint 28 between the rod-shaped member 21 and the second handle 14, and is farther away from the second working portion 12 than the joint 28 between the rod-shaped member 21 and the second handle 14. The joint 28 between the rod-shaped member 21 and the second handle is separated from the joint 27 between the second work portion 12 and the second handle 14.

In the laborsaving pliers of this embodiment, when the second working portion 12 is away from or closer to the first working portion 11, the first groove 18 is moved and rotated away from or closer to the first working portion 11 relative to the first shaft 17, at the same time the second shaft 19 is moved and rotated closer to or away from the first working portion 11 within the second groove 20, which substantially corresponds to the rotation of the second working portion 12 about the virtual shaft center away from or closer to the first working portion 11. The virtual shaft center here is assumed due to the first shaft 17 and the second shaft 19, which is located between the first shaft 17 and the second shaft 19, and since the first shaft 17 is movable relative to the first groove 18 and the second shaft 19 is movable relative to the second groove 20, the virtual shaft center is also movable. Regardless of how the virtual shaft center is moved, the virtual shaft center is closer to the clamping opening than the second shaft 19 (typically the position where the connecting shaft between the movable clamping jaw and the fixed clamping jaw in the existing locking pliers is located), so that the distance between the virtual shaft center and the clamping opening is smaller when compared with the existing locking pliers. If the torque inputted at the contact point between the first working portion 11 and the clamped article is constant, that is, the corresponding torque of the clamping opening is constant, and since the distance between the virtual shaft center and the clamping opening is smaller when compared with the existing locking pliers, the clamping force produced by the clamping opening is greater, that is, the effect of saving labor is achieved.

Figure 8:
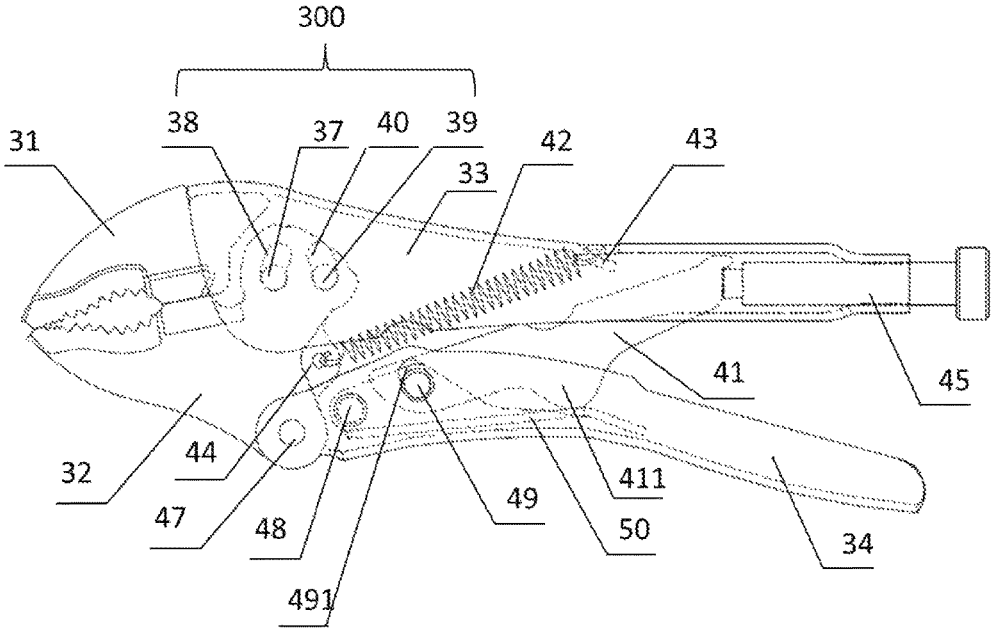
FIG. 8 is a schematic view of water pump pliers for preventing the handles from opening too large in a specific embodiment of the present invention.

FIG. 8 shows another embodiment of the present invention, which provides a hand tool, specifically water pump pliers for preventing the handles from opening too large, including a first handle 33, a second handle 34, a first working portion 31, a second working portion 32, a working portion connecting mechanism 300, a rod-shaped member 41, a stopper mechanism, an elastic member 42, and an adjustment screw 45. Wherein, the first handle 33 is fixedly connected to the first working portion 31, and they may be integrally formed. The second handle 34 is pivotably connected to the second working portion 32. In this embodiment, the working portion connecting mechanism 300 uses the two-shaft arrangement as described earlier, that is, includes a first hole provided in the first working portion 31, a first groove 38 provided in the second working portion 32, and a first shaft 37 extending through the first hole and the first groove 38; a second hole provided in the second working portion 32, a second groove 40 provided in the first working portion 31, and a second shaft 39 extending through the second hole and the second groove 40. The first shaft 37 is closer to the clamping opening formed by the first working portion 31 and the second working portion 32 than the second shaft 39. The first shaft 37 is movable and rotatable within the first groove 38 and the second shaft 39 is movable and rotatable within in the second groove 40 so that the second working portion 32 can be rotated and translated relative to the first working portion 31. Wherein, the first groove 37 and the second groove 39 are arc grooves or may also be square grooves. As an alternative embodiment, the working portion connecting mechanism 300 may also use the one-shaft arrangement as described earlier (not shown here), that is, the working portion connecting mechanism 300 includes a hole provided in the first working portion 31, a groove provided in the second working portion 32, and a shaft extending through the hole in the first working portion 31 and the groove in the second working portion 32. In the case of one-shaft arrangement, the groove may be a horizontal groove, a sloped groove or an arc groove.

In this embodiment, the second working portion 32 has a first position and a second position. The second working portion 32 is connected to the first working portion 31 through the working portion connecting mechanism 300. The working portion connecting mechanism 300 causes the second working portion 32 to move from the first position to the second position when the second handle 34 is moved from away from the first handle 33 to closer to the first handle 33. Here, the first position of the second working portion 32 refers to the position where the second working portion 32 is located away from the first working portion 31, and compared with the first position, the second working portion 32 is rotated and translated relative to the first working portion 11 when the second working portion 32 is in the second position.

In this embodiment, the fit clearance between the first shaft 37 and the first hole and the first groove 38 is less than the fit clearance between the second shaft 39 and the second hole and the second groove 40. In an alternative embodiment of this embodiment, the fit clearance between the first shaft 37 and the first hole and the first groove 38 may also be set to be equal to or greater than the fit clearance between the second shaft 39 and the second hole and the second groove 40. As mentioned earlier, one function of providing two shafts is to bear the external force together by the two shafts, thereby reducing the wear of the shaft and the deformation of the laborsaving pliers, and the other function is to limit the size of the clamping opening by means of the second shaft 39 and to limit the first handle 33 and the second handle 34 from being too large, so that it is convenient for a user to operate with one hand.

In the water pump pliers of this embodiment, a recess extending in the length direction of the first handle 33 is provided within the first handle 33, the opening of the recess faces the second handle 34, and a recess extending in the length direction of the second handle 34 is provided within the second handle 34, and the opening of the recess faces the first handle 33. A first end of the rod-shaped member 41 is provided within the recess of the second handle 34, and the first end of the rod-shaped member 41 is pivotably connected to the second handle 34. A second end of the rod-shaped member 41 and an adjustment screw 45 are provided within the recess of the first handle 33, the second end of the rod-shaped member 41 contacts the adjustment screw 45. The adjustment screw 45 is connected to the tail portion of the first handle 33 through thread. A portion of the adjustment screw 45 extends within the recess of the first handle 33 and the other portion is positioned outside the first handle 33. The adjustment screw 45 causes the second end of the rod-shaped member 41 to be moved relative to the first handle 33 when the adjustment screw 45 is moved relative to the first handle 33.

In the water pump pliers of this embodiment, the stopper mechanism is used for stopping the displacement of the rod-shaped member relative to the second handle. The stopper mechanism includes a kidney-shaped hole 491 provided in the second working portion and a stopper shaft 49 provided within the kidney-shaped hole 491, and the rod-shaped member 41 is pivotably connected to the second handle 34 via the stopper shaft 49, the stopper shaft 49 cooperates with the kidney-shaped hole 491 to form the stopper mechanism. The first working portion 31 and the second working portion 32 are in a released state when the stopper shaft 49 is facing the first handle 33 in the kidney-shaped hole 491, and the first working portion 31 and the second working portion 32 are in a clamped state when the stopper shaft 49 is away from the first handle 33 in the kidney-shaped hole 491.

A third handle 50 is also provided within the recess of the second handle 34, the third handle 50 is connected to the second handle 34, and the third handle 50 is connected to the first end of the rod-shaped member 41 via the stopper shaft 49. The joint 48 between the third handle 50 and the second handle 34 is separated from the joint 47 between the second handle 34 and the second working portion 32, and the joint 48 between the third handle 50 and the second handle 34 is separated from the joint between the third handle 50 and the rod-shaped member 41. The length of the second handle 34 is greater than that of the third handle 50.

During rotation of the second handle 34, the joint between the rod-shaped member 41 and the third handle 50 would pass over the connection line connecting the joint 48 between the third handle 50 and the second handle 34 and the joint 47 between the second handle 34 and the second working portion 32, the first working portion 31 and the second working portion 32 are clamped when the second handle 34 is moved closer to the first handle 33 and passes over the connection line; and the first working portion 31 and the second working portion 32 are released when the second handle 34 is moved away from the first handle 33 and passes over the connection line.

In the water pump pliers of this embodiment, the elastic member 42 is provided between the second working portion 32 and the first handle 33. Specifically, a hanging hole 44 is provided in the second working portion 32, and a hook portion 43 is provided in the first handle 33, one end of the elastic member 42 is restricted within the hanging hole 44 and the other end is connected to the hook portion 43 in the first handle 33. The elastic member 42 is a spring, specifically a tension spring.

Figure 9:
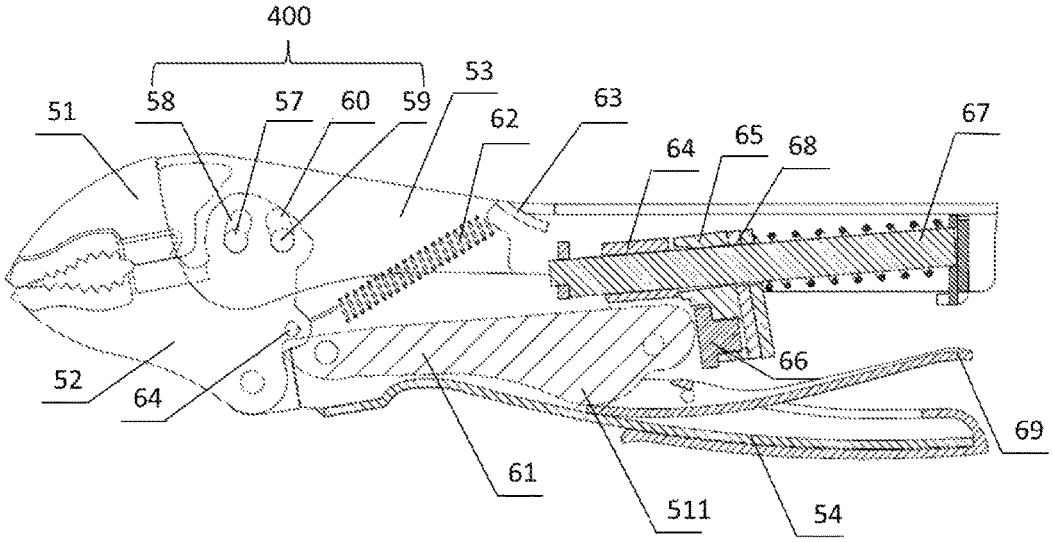
FIG. 9 is a schematic view of self-adjusting water pump pliers in a specific embodiment of the present invention.

FIG. 9 shows a further embodiment of the present invention, which provides a hand tool, specifically self-adjusting water pump pliers, including a first handle 53, a second handle 54, a first working portion 51, a second working portion 52, a working portion connecting mechanism 400, a rod-shaped member 61, a sliding mechanism 64, a locking mechanism, and an adjustment mechanism. Wherein, the first handle 53 is fixedly connected to the first working portion 51, and they may be integrally formed. The second handle 54 is pivotably connected to the second working portion 52.

In this embodiment, the working portion connecting mechanism 400 uses the two-shaft arrangement as described earlier, that is, includes a first hole provided in the first working portion 51, a first groove 58 provided in the second working portion 52, and a first shaft 57 extending through the first hole and the first groove 58; a second hole provided in the second working portion 52, a second groove 60 provided in the first working portion 51, and a second shaft 59 extending through the second hole and the second groove 60. The first shaft 57 is closer to the clamping opening formed by the first working portion 51 and the second working portion 52 than the second shaft 59. The first shaft 57 is movable and rotatable within the first groove 58 and the second shaft 59 is movable and rotatable within the second groove 60 so that the second working portion 52 may be rotated and translated relative to the first working portion 51. Wherein, the first groove 58 and the second groove 60 are arc grooves or may also be square grooves. As an alternative embodiment, the working portion connecting mechanism 400 may also use the one-shaft arrangement as described earlier (not shown here), that is, the working portion connecting mechanism 400 includes a hole provided in the first working portion 51, a groove provided in the second working portion 52, and a shaft extending through the hole in the first working portion 51 and the groove in the second working portion 52. In the case of one-shaft arrangement, the groove may be a horizontal groove, a sloped groove or an arc groove.

In this embodiment, the second working portion 52 has a first position and a second position. The second working portion 52 is connected to the first working portion 51 through the working portion connecting mechanism 400. The working portion connecting mechanism 400 causes the second working portion 52 to move from the first position to the second position when the second handle 54 is moved from away from the first handle 53 to closer to the first handle 53. Here, the first position of the second working portion 52 refers to the position where the second working portion 52 is located away from the first working portion 51, and compared with the first position, the second working portion 52 is rotated and translated relative to the first working portion 51 when the second working portion 2 is in the second position.

In this embodiment, the fit clearance between the first shaft 57 and the first hole and the first groove 58 is less than the fit clearance between the second shaft 59 and the second hole and the second groove 60. In an alternative embodiment of this embodiment, the fit clearance between the first shaft 57 and the first hole and the first groove 58 may also be set to be equal to or greater than the fit clearance between the second shaft 59 and the second hole and the second groove 60. As mentioned earlier, one function of providing two shafts is to bear an external force together by the two shafts, thereby reducing the wear of the shaft and the deformation of the laborsaving pliers, and the other function is to limit the size of the clamping opening by means of the second shaft 59.

In this embodiment, the sliding mechanism 64 is slidably mounted on the first handle 53, one end of the rod-shaped member 61 is pivotably connected to the second handle and the other end is pivotably mounted onto the sliding mechanism. One end of the rod-shaped member 61 connected to the sliding mechanism 64 is constituted by curve segments, and the curvature of the curve segment closer to the first handle 53 is greater than that of the curve segment away from the first handle 53.

The locking mechanism is slidably mounted onto the first handle 53 and located on the distal end of the slide mechanism 64 close to the the first handle 53. The distal end here refers to the end away from the clamping opening. The locking mechanism includes a guide rod 67 and a locking tab 68, the guide rod 67 is mounted on the first handle 53 and equipped through the locking tab 68. The locking tab 68 is formed of a plurality of pieces, and the plurality of pieces of the locking tab are attached to each other. The cross-section of the guide rod 67 is a trapezium with rounded corners, and the locking tab 68 has an aperture in the middle through which the guide rod 67 passes, the aperture is provided with the same shape as the cross-section of the guide rod 67, there is a clearance fit between the guide rod 67 and the locking tab 68.

In this embodiment, the adjustment mechanism is mounted on the guide rod 67 and is located between the sliding mechanism and the locking mechanism, and the adjustment mechanism is configured to be displaceable in the length direction of the guide rod 67. In the case where the adjustment mechanism reaches the maximum displacement towards either end of the guide rod 67, one end of the rod-shaped member 61 connected to the sliding mechanism may be brought into contact with the adjustment mechanism when the water pump pliers of this embodiment are locked.

Specifically, the adjustment mechanism includes an adjustment bolt 66 and a carrier 65, and the carrier 65 is mounted on the guide rod 67, the adjustment bolt 66 is mounted on the carrier 65 and is displaced in the direction of the guide rod 67 relative to the carrier 65. The cross-section of the carrier 65 is the same as that of the locking tab 68 and has the same aperture as the shape of the locking tab 68 at the same position as the locking tab 68, and the guide rod 67 passes through the aperture on the carrier 65.

In this embodiment, a recess is provided within the second handle 54, the opening of the recess faces the first handle 53, and a third handle 69 is pivotably connected within the recess of the second handle 54. The third handle 69 has an elongated end which, when the third handle 69 is pivoted relative to the second handle 54, can abut against the second handle 54 to prevent the third handle 69 from continuing being pivoted relative to the second handle 54. In addition, the rod-shaped member 61 has a protrusion 511, the water pump pliers are locked when the protrusion 511 in the rod-shaped member 61 enters the recess of the second handle 54; the elongated end can push the protrusion 511 out from the recess of the second handle 54 to unlock the water pump pliers when the third handle 69 is turned towards the second handle 54.

The self-adjusting water pump pliers of this embodiment further includes an elastic member 62 provided between the second working portion and the first handle, specifically, a hanging hole 64 is provided in the second working portion 52, and a hook portion 63 is provided within the recess of the first handle 53. One end of the elastic member 62 is restricted within the hanging hole and the other end is connected to the hook portion 63. The elastic member 62 of this embodiment is a spring, specifically a tension spring.

The preferred specific embodiments of the invention have been described in detail above. It is to be understood that numerous modifications and variations can be made by those ordinary skilled in the art in accordance with the concepts of the present invention without any inventive effort. Hence, the technical solutions that may be derived by those skilled in the art according to the concepts of the present invention on the basis of the prior art through logical analysis, reasoning and limited experiments should be within the scope of protection defined by the claims.

The invention claimed is:

1. A hand tool, comprising:

a first handle and a first working portion fixedly connected to the first handle;

a second handle and a second working portion pivotably connected to the second handle, the second working portion having a first position and a second position; and a working portion connecting mechanism through which the second working portion is connected to the first working portion, and the working portion connecting mechanism is configured such that, when the second handle is away from the first handle, and is moved closer to the first handle, the working portion connecting mechanism causes the second working portion to be moved from the first position to the second position;

wherein the first position is a position where the second working portion is located away from the first working portion, and compared with the first position, the second working portion is rotated and translated relative to the first working portion when the second working portion is in the second position;

wherein the working portion connecting mechanism comprises:

a first hole provided in the first working portion, a first groove provided in the second working portion, and a first shaft extending through the first hole and the first groove;

a second hole provided in the second working portion, a second groove provided in the first working portion, and a second shaft extending through the second hole and the second groove; and the first shaft being movable and rotatable within the first groove, and the second shaft being movable and rotatable within the second groove so that the second working portion can be rotated and translated relative to the first working portion.

2. The hand tool according to claim 1, wherein the first groove is a horizontal groove, a sloped groove or an arc groove.

3. The hand tool according to claim 1, wherein a fit clearance between the first shaft and the first hole and the first groove is greater than, less than or equal to a fit clearance between the second shaft and the second hole and the second groove.

4. The hand tool according to claim 1, wherein the first groove is an arc groove or a square groove.

5. The hand tool according to claim 1, wherein the second groove is an arc groove or a square groove.

6. A hand tool, comprising:

a first handle and a first working portion fixedly connected to the first handle;

a second handle and a second working portion pivotably connected to the second handle; the second working portion having a first position and a second position;

a working portion connecting mechanism through which the second working portion is connected to the first working portion, and the working portion connecting mechanism is configured such that, when the second handle is moved from away from the first handle to closer to the first handle, the working portion connecting mechanism causes the second working portion to be moved from the first position to the second position; and a rod-shaped member which is provided between the second handle and the first handle; wherein the first position is a position where the second working portion is located away from the first working portion, and compared with the first position, the second working portion is rotated and translated relative to the first working portion when the second working portion is in the second position;

wherein the working portion connecting mechanism comprises:

a first hole provided in the first working portion, a first groove provided in the second working portion, and a first shaft extending through the first hole and the first groove;

a second hole provided in the second working portion, a second groove provided in the first working portion, and a second shaft extending through the second hole and the second groove; and the first shaft being movable and rotatable within the first groove, and the second shaft being movable and rotatable within the second groove so that the second working portion can be rotated and translated relative to the first working portion.

7. The hind tool according to claim 6, wherein the first groove is a horizontal groove, a sloped groove or an arc groove.

8. The hand tool according to claim 6, wherein a fit clearance between the first shaft and the first hole and the first groove is less than, equal to or greater than a fit clearance between the second shaft and the second hole and the second groove.

9. The hand tool according to claim 6, wherein the first groove is an arc groove or a square groove.

10. The hand tool according to claim 6, wherein the second groove is an arc groove or a square groove.

11. The hand tool according to claim 6, wherein the hand tool further comprises an elastic member provided between the second working portion and the first handle.

12. The hand tool according to claim 11, wherein a hanging hole is provided in the second working portion, a hook portion is provided in the first handle, one end of the elastic member is restricted within the hanging hole and the other end is connected to the hook portion.

13. The hand tool according to claim 6, wherein the hand tool further comprises an adjustment screw, the adjustment screw is connected to a tail portion of the first handle through thread.

14. The hand tool according to claim 13, wherein the rod-shaped member has a first end and a second end, the first end of the rod-shaped member is pivotably connected to the second handle, and the second end of the rod-shaped member is pivotably connected to the first handle and abuts against the adjustment screw.

15. The hand tool according to claim 14, wherein the adjustment screw causes the second end of the rod-shaped member to be moved relative to the first handle when the adjustment screw is moved relative to the first handle.

16. The hand tool according to claim 13, wherein a recess is provided within the first handle, an opening of the recess faces the second handle.

17. The hand tool according to claim 16, wherein a portion of the adjustment screw extends within the recess of the first handle and another portion is positioned outside the first handle.

18. The hand tool according to claim 6, wherein a recess is provided within the second handle, an opening of the recess faces the first handle.

19. The hand tool according to claim 18, wherein a third handle is pivotably connected within the recess of the second handle.

20. The hand tool according to claim 19, wherein the length of the third handle is less than that of the second handle.

21. The hand tool according to claim 19, wherein the third handle has an elongated end, when the third handle is pivoted relative to the second handle, the elongated end can abut against the second handle to prevent the third handle from continuing being pivoted relative to the second handle.

22. The hand tool according to claim 21, wherein the rod-shaped member has a protrusion, the hand tool is locked when the protrusion enters the recess of the second handle; the elongated end can push the protrusion out from the recess of the second handle to unlock the hand tool when the third handle is rotated towards the second handle.

23. The hand tool according to claim 19, wherein a joint between the third handle and the second handle is separated from a joint between the rod-shaped member and the second handle, and is farther away from the second working portion than the joint between the rod-shaped member and the second handle.

24. The hand tool according to claim 23, wherein the joint between the rod-shaped member and the second handle is separated from the joint between the second working portion and the second handle.

25. The hand tool according to claim 1, wherein a fit clearance between the first shaft and the first hole and the first groove is greater than, less than or equal to a fit clearance between the second shaft and the second hole and the second groove.

* * * * *